US012601333B2

(12) United States Patent
Enke

(10) Patent No.: US 12,601,333 B2
(45) Date of Patent: Apr. 14, 2026

(54) STRAIGHT AXIS VARIABLE DISPLACEMENT PISTON PUMP WITH ROTATING SWASH PLATE

(71) Applicant: Hamilton Sundstrand Corporation, Charlotte, NC (US)

(72) Inventor: Olaf Enke, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 18/748,349

(22) Filed: Jun. 20, 2024

(65) Prior Publication Data

US 2025/0389259 A1 Dec. 25, 2025

(51) Int. Cl.

| | |
|---|---|
| ***F04B 1/2085*** | (2020.01) |
| ***F04B 1/16*** | (2006.01) |
| ***F04B 1/2092*** | (2020.01) |
| ***F04B 1/306*** | (2020.01) |
| ***F04B 3/00*** | (2006.01) |
| ***F04B 27/06*** | (2006.01) |
| ***F04B 27/08*** | (2006.01) |
| ***F04B 27/22*** | (2006.01) |

(52) U.S. Cl.

CPC ..... *F04B 1/2085* (2013.01); *F04B 1/16* (2013.01); *F04B 1/2092* (2013.01); *F04B 1/306* (2013.01); *F04B 3/006* (2013.01); *F04B 27/0657* (2013.01); *F04B 27/0808* (2013.01); *F04B 27/0865* (2013.01); *F04B 27/22* (2013.01)

(58) Field of Classification Search

CPC ..... F04B 1/16; F04B 1/2035; F04B 1/2085; F04B 1/2092; F04B 1/306; F04B 3/003; F04B 3/006; F04B 19/025; F04B 27/06; F04B 27/0657; F04B 27/0804; F04B 27/0808; F04B 27/0817; F04B 27/0834; F04B 27/0865; F04B 27/0869; F04B 27/12; F04B 27/20; F04B 27/22

See application file for complete search history.

(56) References Cited

U.S. PATENT DOCUMENTS

| | | | |
|---|---|---|---|
| 3,592,105 | A | 7/1971 | Fryklund |
| 3,641,829 | A | 2/1972 | Reynolds |
| 5,205,123 | A | 4/1993 | Dunstan |
| 5,803,714 | A | 9/1998 | Tominaga et al. |
| 6,668,801 | B2 | 12/2003 | Smith et al. |
| 10,174,746 | B2 | 1/2019 | Conde et al. |
| 10,533,544 | B2 | 1/2020 | Funasaka et al. |
| 10,808,686 | B2 | 10/2020 | Maekawa et al. |
| 2004/0042910 | A1 | 3/2004 | Gleasman et al. |

(Continued)

FOREIGN PATENT DOCUMENTS

| | | | |
|---|---|---|---|
| CN | 104405606 | A | 3/2015 |
| CN | 105257495 | B | 8/2018 |

(Continued)

*Primary Examiner* — Binh Q Tran

(74) *Attorney, Agent, or Firm* — Kinney & Lange, P.A.

(57) ABSTRACT

An axial variable displacement piston pump includes a drive shaft disposed on an axis, a piston barrel comprising a plurality of pistons disposed about the drive shaft, and a swash plate disposed about the drive shaft. Each of the piston barrel and the swash plate are rotationally coupled to the drive shaft such that the drive shaft is configured to simultaneously drive rotation of each of the piston barrel and the swash plate.

20 Claims, 6 Drawing Sheets

(56) References Cited

U.S. PATENT DOCUMENTS

| | | | | |
|---|---|---|---|---|
| 2005/0172798 | A1* | 8/2005 | Kadlicko | F04B 1/2042 92/71 |
| 2016/0069342 | A1* | 3/2016 | May | F04B 1/2042 137/601.16 |
| 2017/0298912 | A1* | 10/2017 | Dyminski | F04B 27/0826 |
| 2018/0051799 | A1* | 2/2018 | Yuan | F16H 47/07 |
| 2019/0113028 | A1* | 4/2019 | Hemink | F01B 3/0085 |
| 2020/0392948 | A1* | 12/2020 | Lee | F04B 45/022 |
| 2021/0095647 | A1* | 4/2021 | Parsons | F04B 53/162 |
| 2021/0164456 | A1* | 6/2021 | Tricard | F04B 1/324 |
| 2021/0231112 | A1 | 7/2021 | Kawakita et al. | |

FOREIGN PATENT DOCUMENTS

| | | | |
|---|---|---|---|
| KR | 19980070979 | A | 10/1998 |
| KR | 20020090245 | A | 12/2002 |

* cited by examiner $0^{o}$ tilt $5^{o}$ tilt $10^{o}$ tilt $15^{o}$ tilt

STRAIGHT AXIS VARIABLE DISPLACEMENT PISTON PUMP WITH ROTATING SWASH PLATE

BACKGROUND

The present disclosure relates generally to pumps and more particularly to variable displacement piston pumps.

Variable displacement piston pumps can be used to pressurize and deliver fuel for aerospace fuel systems. Delivery flow can be adjusted by varying the inclination or tilt angle of a swash plate against which pistons reciprocate, which changes the stroke length of the pistons. Conventional variable displacement piston pumps have a rotating piston barrel with pistons that rotate against a swash plate that has a variable tilt angle but is rotationally fixed relative to rotation of the piston barrel. As the piston barrel rotates against the titled swash plate, pistons move in and out of their respective cylinders. Piston shoes provide an interface between the reciprocating pistons and the swash plate. The piston shoes slide over the surface of the swash plate as the piston barrel rotates. The interaction between the swash plate and the piston shoes can pose several issues including but not limited to wear caused by friction, uneven loading and localized stress caused by misalignment, heat generation from friction, and mechanical damage due to impact loads and/or vibration. The continuous sliding of the piston shoes against the swash plate can increase or cause uneven wear, resulting in lowered efficiency and increased risk of failure. Friction between a piston shoe and the swash plate becomes more critical with higher fuel temperatures and pressures.

More robust variable displacement piston pump designs are needed for applications requiring higher fuel temperatures and pressures.

SUMMARY

An axial variable displacement piston pump includes a drive shaft disposed on an axis, a piston barrel comprising a plurality of pistons disposed about the drive shaft, and a swash plate disposed about the drive shaft. Each of the piston barrel and the swash plate are rotationally coupled to the drive shaft such that the drive shaft is configured to simultaneously drive rotation of each of the piston barrel and the swash plate.

The present summary is provided only by way of example, and not limitation. Other aspects of the present disclosure will be appreciated in view of the entirety of the present disclosure, including the entire text, claims and accompanying figures.

BRIEF DESCRIPTION OF THE DRAWINGS

FIG. 1A shows swash plate in a neutral position. FIG. 1B shows swash plate disposed at a 15-degree tilt angle.

Figure 1A:
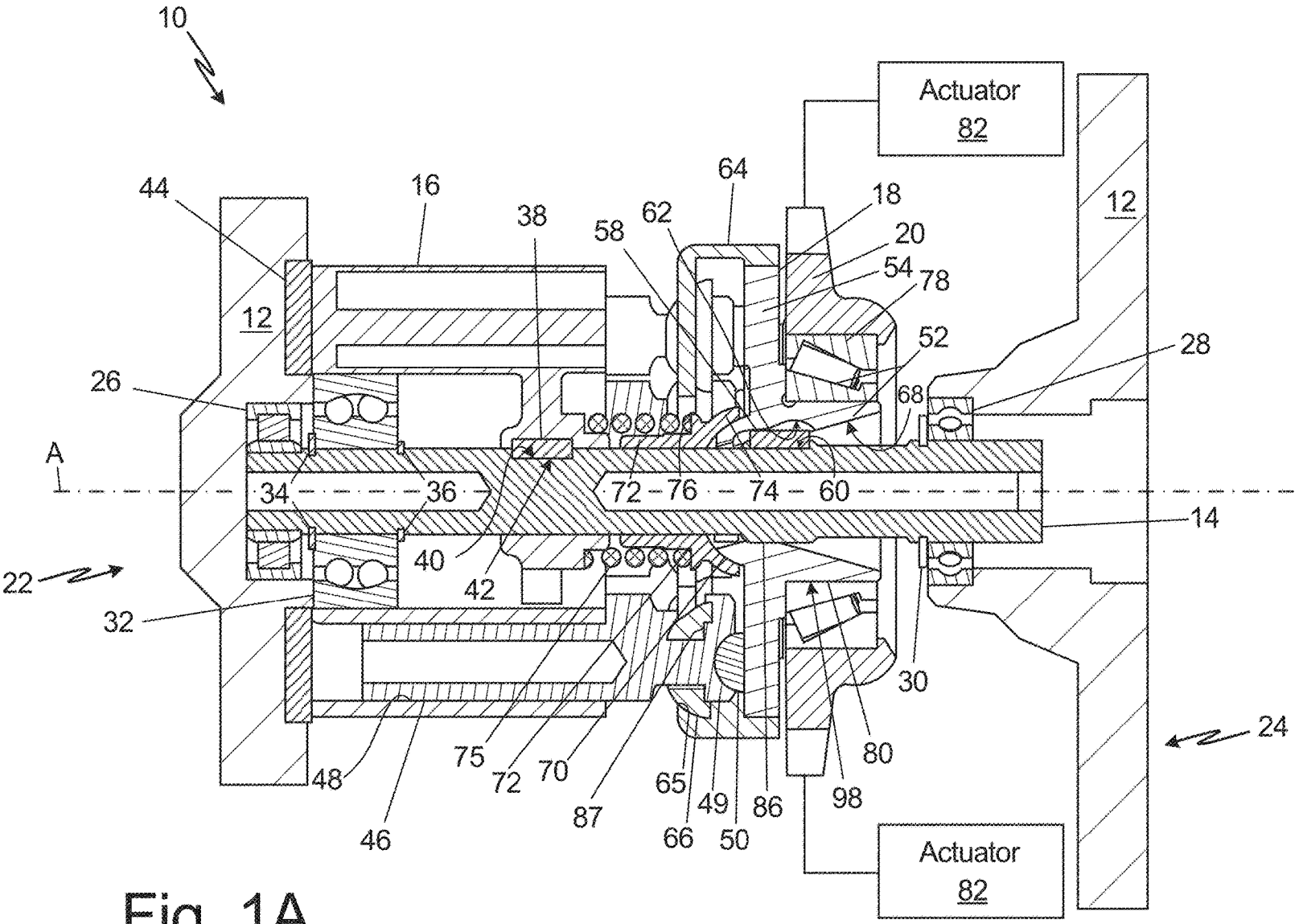
FIGS. 1A and 1B are a cross-sectional view of a straight axis variable displacement piston pump having co-rotating piston barrel and swash plate.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The present disclosure is directed to a straight axis variable displacement pump having a swash plate that rotates with a piston barrel to minimize friction between a piston shoe and swash plate. The reduced friction increases the robustness of the pump at higher fuel temperatures and pressures, as desired for fuel aerospace fuel systems. An axial load acting on the swash plate is transferred to a base plate through tapered roller bearings thereby minimizing production of heat due to friction as compared to conventional variable displacement piston pumps having a stationary swash plate and rotating cylinder barrel. A keyway design provides constant positive engagement between a drive shaft and the swash plate to transfer the rotational load of the drive shaft to the swash plate while allowing the swash plate to pivot relative to the drive shaft during rotation.

Figure 1B:
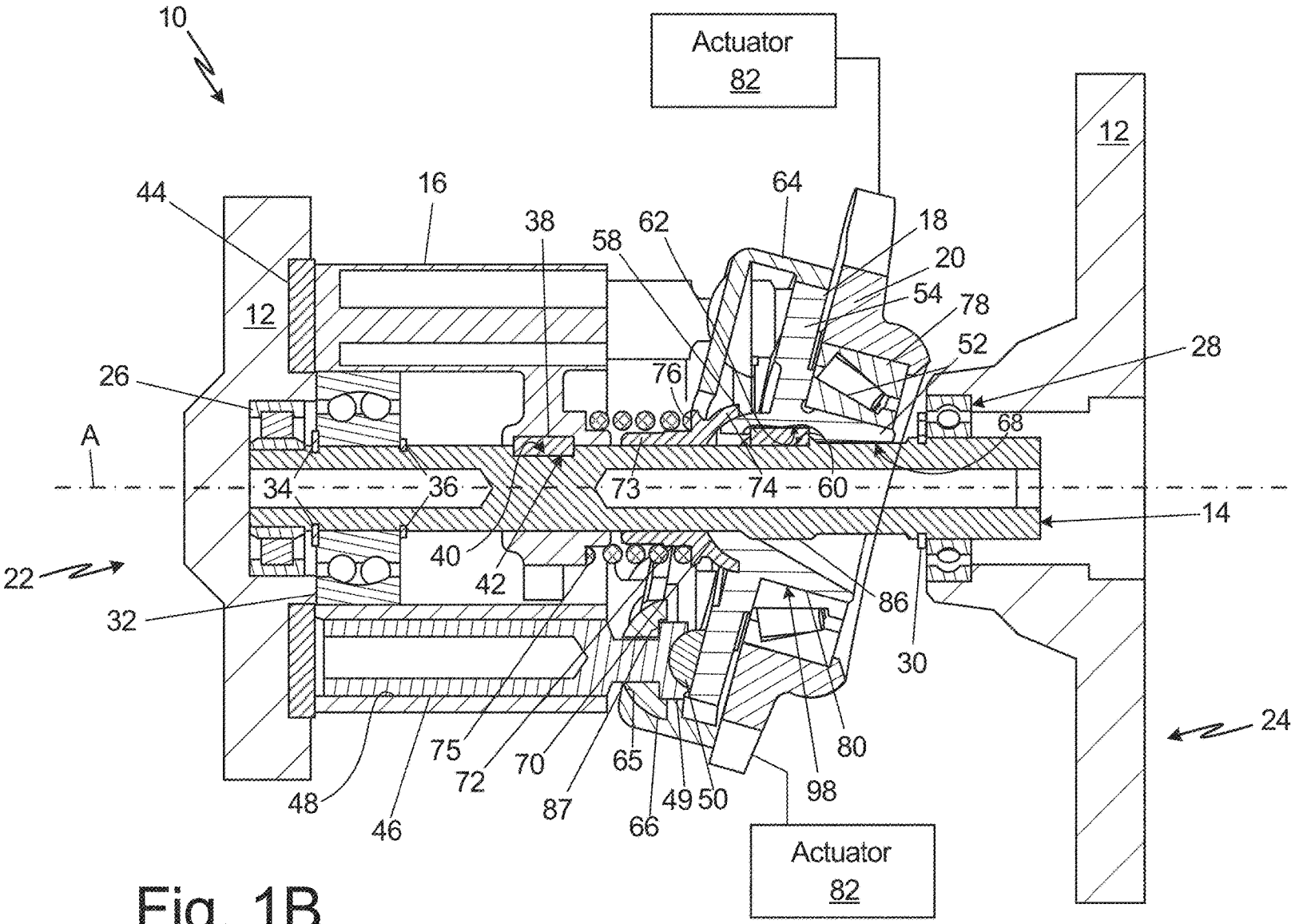

FIGS. 1A and 1B are a cross-sectional view of a straight axis variable displacement piston pump, referred to hereinafter as pump 10. FIG. 1A shows a swash plate in a neutral position (no pump flow). FIG. 1B shows the swash plate disposed at a 15-degree tilt angle. FIGS. 1A and 1B show pump 10, housing 12, drive shaft 14, piston barrel 16, swash plate 18, and base plate 20. FIGS. 1A and 1B are discussed together herein.

Housing 12 can enclose internal components of pump 10 between first end 22 and second end 24 and supports drive shaft 14. A fluid inlet (not shown) and fluid outlet (not shown) to piston barrel 16 can be provided in first end 22 of housing 12. Drive shaft 14 is disposed on axis A and received in housing 12 at first end 22 and second end 24. Drive shaft 14 can be rotationally supported at first end 22 of housing 12 by bearing 26 and at second end 24 of housing 12 by bearing 28. As shown in FIGS. 1A and 1B, bearing 26 can be, for example, a cylindrical roller bearing suitable for handling high radial load. Bearing 28 can be, for example, a ball bearing. Retaining ring 30 can retain an axial position of bearing 28. Retaining ring 30 can be, for example, a circlip. Retaining ring 30 can be received in a slot (shown in FIG. 2) in drive shaft 14. Drive shaft 14 is configured to drive rotation of piston barrel 16 and swash plate 18.

Piston barrel 16 is disposed adjacent to first end 22 of housing 12. Piston barrel 16 is disposed on axis A and is supported on drive shaft 14 by bearing 32. Bearing 32 can be a self-aligning ball bearing configured to maintain alignment of piston barrel 16 in housing 12. Retaining rings 34 and 36 can be disposed on either side of bearing 32 on drive shaft 14 to retain an axial position of bearing 32 on drive shaft 14. Retaining rings 34 and 36 can be, for example, circlips. Retaining rings 34 and 36 can be received in respective slots (shown in FIG. 2) in drive shaft 14. Piston barrel 16 can be rotationally fixed to drive shaft 14 by key 38. Key 38 can be a block received in key seat or slot 40 in drive shaft 14 and keyway or slot 42 in piston barrel 16. Key 38 can be configured to transfer torque from drive shaft 14 to piston barrel 16. Key 38 and corresponding slots 40 and 42 can block circumferential movement of piston barrel 16 with respect to drive shaft 14.

Piston barrel 16 can rotate against thrust plate 44 disposed between piston barrel 16 and housing 12. Thrust plate 44 can provide a sliding and sealing interface between rotating piston barrel 16 and stationary housing 12. Thrust plate 44 can help accommodate axial load of reciprocating pistons 46 housed in piston barrel 16 and prevent fluid leaks.

Piston barrel 16 includes a plurality of circumferentially spaced cylinder bores 48 or bores within which pistons 46 are slidingly received. Pistons 46 reciprocate in cylinder bores 48, as known in the art, to draw fluid into piston barrel 16 though housing 12 at first end 22 and discharge fluid from piston barrel 16 through housing 12 at first end 22. Pistons 46 reciprocate as they rotate with a tilted swash plate 18.

A piston head 49 of each piston 46 can be received in or on piston shoe 50, which is placed adjacent to swash plate 18. As shown in FIGS. 1A and 1B, piston shoe 50 can have a hemispherical shape having a flat surface disposed on swash plate 18 and a convex surface received in a concave piston head 49 of piston 46. In other embodiments, piston 46 can have a ball-shaped head received in a rocker or cradle-shaped shoe as known in the art. Piston shoes 50 are free to slide radially against swash plate 18 as pistons 46 reciprocate. Piston shoes 50 are rotationally coupled to each of pistons 46 and swash plate 18, which minimizes heat produced by friction and wear as compared to prior art designs in which the swash plate and piston barrel are not rotationally coupled.

Swash plate 18 is disposed on axis A between pistons 46 and base plate 20. Swash plate 18 includes hub 52 and disc 54 Hub 52 is received on drive shaft 14. Disc 54 extends radially outward from hub 52. Swash plate 18 is rotationally fixed to drive shaft 14 by key 58. As discussed further herein, key 58 is received in key seat or slot 60 in drive shaft 14 and in keyway or slot 62 in swash plate 18. Key 58 is configured to transfer torque from drive shaft 14 to swash plate 18. Key 58 and corresponding slots 60 and 62 are configured to block circumferential movement of swash plate 18 relative to drive shaft 14 while allowing swash plate 18 to pivot relative to drive shaft 14. In some examples, key 58 can be press fit into the slot 60 such that key 58 does not move out of slot 60 while the swash plate rotates under load.

Disc 54 interfaces with piston shoes 50. Retention cage 64 can be provided to retain piston shoes 50 and corresponding piston heads 49 relative to swash plate 18. Retention cage 64 can be fixed to disc 54 of swash plate 18 to rotate therewith. As shown in FIGS. 1A and 1B, retention cage can be fixed to an outer diameter of disc 54. Retention cage 64 includes a plurality of circumferentially spaced openings configured to receive piston heads 49. In some embodiments, retention members 66 can be disposed around pistons 46 adjacent to piston heads 49 to retain piston heads 49 in retention cage 64.

Hub 52 can interface with drive shaft 14 via key 58. As described further herein, hub 52 has radially inner surface 68 that is configured to allow tilting of disc 54 relative to axis A and piston barrel 16 without interference from drive shaft 14. A variable inclination or tilt angle of swash plate 18 controls the stroke length of pistons 46.

A forward end 70 of hub 52 can be received in socket 72. Socket 72 is disposed about drive shaft 14 between piston barrel 16 and swash plate 18. Socket 72 can include sleeve 73 and cradle 74. Sleeve 73 can form a forward end of socket 72 and interface with drive shaft 14. Cradle 74 can form an aft end of socket 72 and can be configured to receive forward end 70 of swash plate 18. Cradle 74 can have a concave surface extending outward from drive shaft 14 and configured to receive a corresponding surface of hub forward end 70. Hub 52 is free to rock within cradle 74 as the tilt angle of swash plate 18 is varied.

Spring 75 can be disposed about sleeve 73 of socket 72 between cradle 74 and piston barrel 16. Socket 72 can have an annular flange 76 extending radially outward from sleeve 73 adjacent to cradle 74 which spring 75 axially abuts. Flange 76 can retain spring 75 between cradle 74 and piston barrel 16. Spring 75 can bias socket 72 against swash plate 18 and can accommodate changes in axial load exerted by pistons 46 against swash plate 18. Spring 75 can further support a constant contact between piston barrel 16 and thrust plate 44.

Swash plate 18 can be rotationally coupled to base plate 20 by bearing 78. Base plate 20 is rotationally fixed with respect to swash plate 18. Bearing 78 can be disposed adjacent to disc 54 at an aft end 80 of hub 52 opposite socket 72. Bearing 78 is configured to allow swash plate 18 to rotate with respect to base plate 20. An axial load acting on swash plate 18 by pistons 46 is transferred to base plate 20 through bearing 78, thereby minimizing production of heat due to friction as compared to prior art designs in which the swash plate and piston barrel are not rotationally coupled. Swash plate 18 can be centered through bearing 78 to avoid any unbalancing during rotation. In some examples, as illustrated in FIGS. 1A and 1B, bearing 78 can be a tapered roller bearing, which can provide high axial load transmission from swash plate 18 to base plate 20. In other examples, other bearings, including ball bearings with a shoulder, may be suitable for transmitting the axial load and maintaining balance with rotation and tilting of swash plate 18.

As discussed further herein, base plate 20 is configured to vary the tilt angle of swash plate 18. Base plate 20 can be connected to one or more actuators 82 (shown schematically). One or more actuators 82 are configured to tilt base plate 20 and thereby swash plate 18 with respect to drive shaft 14 and axis A.

As piston barrel 16 and swash plate 18 rotate, the tilted swash plate 18 (FIG. 1B) converts rotary motion of piston barrel 16 to reciprocating motion of pistons 46. As piston barrel 16 and swash plate 18 rotate, pistons 46 are pushed in and out of their respective cylinder bores 48 against swash plate 18. The tilt angle of swash plate 18 determines the stoke length of pistons 46. When swash plate 18 is tilted relative to axis A and drive shaft 14, pistons 46 are pushed in and out of their respective cylinder bores 48 by swash plate 18 as piston barrel 16 and swash plate 18 rotate. The tilt angle of swash plate 18 can be adjusted to increase or decrease volumetric flow from pump 10. When the tilt angle is increased, the volumetric output is increased. The tilt angle of swash plate 18 can be automatically adjusted based on the fuel system's pressure or volumetric flow requirements as known in the art.

Figure 2:
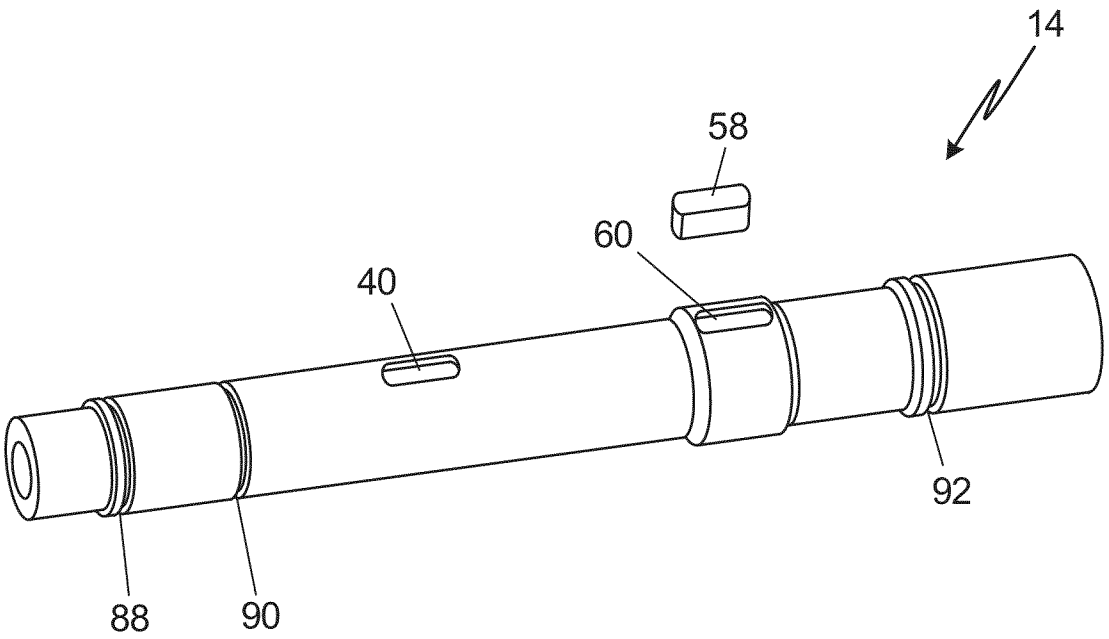
FIG. 2 is a perspective view of a drive shaft of the pump of FIG. 1 and a key configured to transmit torque to the swash plate.
Figure 3B:
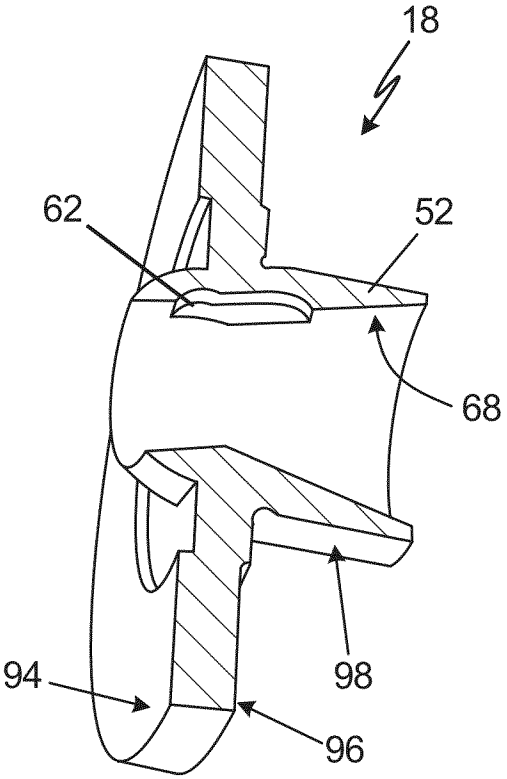
FIG. 3B is a cross-sectional view of the swash plate.
Figure 3A:
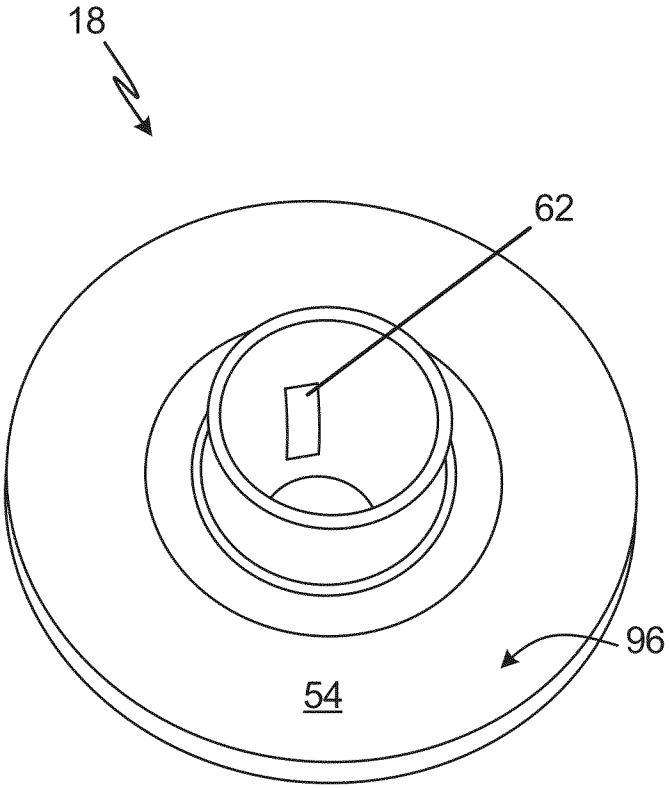
FIG. 3A is a perspective view of the swash plate.

FIG. 2 is a perspective view of drive shaft 14 and key 58. FIG. 3A is a perspective view of swash plate 18. FIG. 3B is a cross-sectional view of swash plate 18. FIGS. 4A-4D are enlarged cross-sectional schematic views of swash plate 18 and drive shaft 14 at the location of key 58. FIGS. 2, 3A, 3B, and 4A-4D are discussed together.

FIG. 2 shows drive shaft 14 having slots 40 and 60 configured to seat keys 38 and 58, respectively. Slots 40 and 60 are recessed openings in drive shaft 14 having a shape corresponding to their respective keys 38 and 58. Keys 38 and 58 can be retained in drive shaft 14 by a press fit. Slot 60 can be provided in a raised annular land 86, extending radially outward from drive shaft 14. Raised annular land 86 can interface with inner surface 68 of swash plate hub 52. Swash plate 18 can pivot about raised annular land 86. Keys 38 and 58 transfer the rotational load of drive shaft 14 to piston barrel 16 and swash plate 18, respectively, and thereby drive rotation of piston barrel 16 and swashplate 18.

As previously described, drive shaft can additionally include annular slots 88, 90 configured to receive retaining rings 34 and 36, respectively, and annular slot 92 configured to receive retaining ring 30. Bearing 32 (shown in FIGS. 1A and 1B) can be disposed on an annular land between annular slots 88 and 90. Bearing 26 (shown in FIGS. 1A and 1B) can be disposed on an annular land adjacent to and aft of annular slot 92.

FIGS. 3A and 3B show swash plate 18 having hub 52, disc 54, and slot 62. Hub 52 can be an annular body configured to be received on drive shaft 14 in a manner that allows swash plate 18 to tilt with respect to drive shaft 14 without interference. Disc 54 extends radially outward from hub 52. Disc 54 can be located closer to a forwardmost end of hub 52 adjacent to socket 72 than an aftmost end of hub 52. Disc 54 has a planar surface on a first side 94 configured to interface with piston shoes 50. Disc 54 can have a planar surface on an opposing second side 96. The second side 96 of disc 54 faces base plate 20 but is separated therefrom. A portion of second side 96 adjacent to hub 52 can be fixed to an inner race of bearing 78 (shown in FIGS. 1A and 1B) to rotate therewith.

Hub 52 can have forward end 70, aft end 80, radially inner surface 68, and opposing radially outer surface 98. Forward end 70 extends axially outward from first side 94 of disc. Aft end 80 extends axially outward from second side 96 of disc. Radially inner surface 68 faces drive shaft 14. Slot 62 is formed in radially inner surface 68 and open thereto.

Radially outer surface 98 of forward end 70 can have a contoured surface corresponding to a surface of socket cradle 74 in which forward end 70 is received. Radially outer surface 98 at forward end 70 can have a curved surface defined by a decreasing diameter from a location adjacent to disc 54 to the forwardmost end of hub 52. Forward end 70 of hub 52 can be configured to slide against a surface of cradle 74 as the tilt angle of swash plate 18 is changed.

Radially outer surface 98 of aft end 80 can have a cylindrical surface configured to receive the inner race of bearing 78 (shown in FIGS. 1A and 1B). Radially outer surface 98 of aft end 80 is fixed to the inner race of bearing 78 and configured to rotate therewith.

Radially inner surface 68 at aft end 80 can be defined by an expanding diameter to the aftmost end of hub 52. Radially inner surface 68 at end forward end 70 can similarly be defined by an expanding diameter to the forwardmost end of hub 52. As shown in FIG. 3B, the inner diameter of hub 52 at the aftmost end can be greater than an inner diameter at the forwardmost end. The expanding diameters of radially inner surface 68 allow swash plate 18 to pivot or tilt on drive shaft 14 without interference from drive shaft 14. The maximum inner diameter can be selected to provide a desired maximum tilt angle of swash plate 18. Radially inner surface 68 at aft end 80 can be frustoconical and configured to extend substantially parallel to drive shaft 14 when swash plate 18 is positioned with a maximum tilt angle (shown in FIGS. 1A and 1B). A thickness of hub 52 at aft end 80 can decrease from disc 54 to the aftmost end of hub 52 to provide a cylindrical radially outer surface 98 and frustoconical radially inner surface 68.

Slot 62 is formed in hub 52. Slot 62 opens to radially inner surface 68. Slot 62 can be axially aligned with or axially overlap with disc 54. As shown in FIGS. 1A and 1B, slot 62 can extend axially forward of first side 94 and/or axially aft of second side 96 of disc 54. Slot 62 has a circumferential thickness and axial length greater than a corresponding thickness and length of key 58 to allow swash plate 18 to pivot about key 58 when the tilt angle of swash plate 18 is changed. Hub 52 can have a minimum inner diameter located in the region of slot 62 configured to interface with drive shaft 14.

Figure 4A:
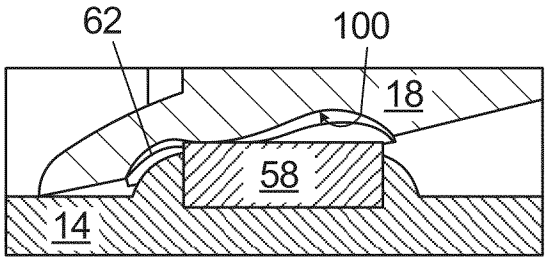
FIGS. 4A-4D are enlarged cross-sectional schematic views of the relative movement between the swash plate and drive shaft about the key in a receiving slot of the swash plate at four different swash plate tilt angles.
Figure 4B:
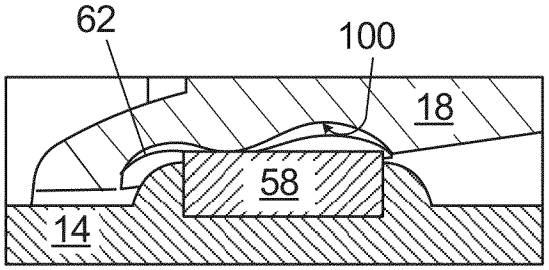
Figure 4C:
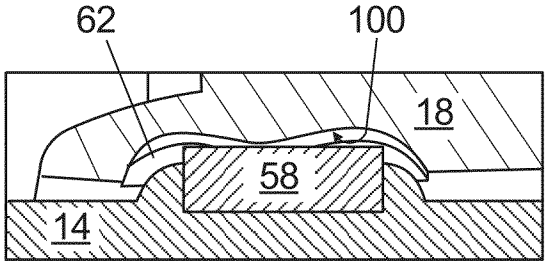
Figure 4D:
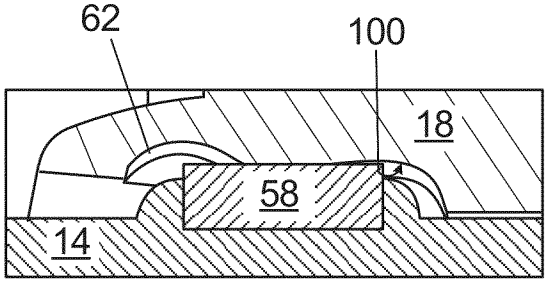

FIGS. 4A-4C show the relative movement between swash plate 18 and drive shaft 14 about key 58 in slot 62 at four different swash plate tilt angles. FIG. 4A shows swash plate orientated at a zero-degree tilt in which disc 54 is perpendicular to drive shaft 14 and axis A. There is no volumetric flow when swash plate 18 is perpendicular to drive shaft 14 and thereby no axial load exerted by pistons 46 against swash plate 18. FIG. 4B shows swash plate 18 oriented at a 5-degree tilt angle. FIG. 4C shows swash plate 18 oriented at a 10-degree tilt angle. FIG. 4D shows swash plate 18 oriented at a 15-degree, or maximum, tilt angle. As previously described key 58 transfers the rotational load of drive shaft 14 to swash plate 18 while allowing relative movement between swash plate 18 and drive shaft 14 when the tilt angle of swash plate 18 is changed. A constant positive engagement between drive shaft 14 and swash plate 18 via key 58 remains present while swash plate 18 pivots between zero and 15 degrees to allow continued transmission of torque from drive shaft 14 to swash plate 18. Preferably, the positive engagement surface increases as load increases (i.e., with increased tilt angle and thereby increased pressure and/or volumetric output from piston barrel 16) to reduce the contact stress.

Slot 62 is configured to provide a large contact surface for transfer of torque independent of the tilt angle of swash plate 18. As shown in FIGS. 4A-4B, slot 62 can have an axial length greater than an axial length of key 58 to allow pivot of swash plate 18 about key 58. Slot 62 has a radial height sufficient to accommodate key 58 while maximizing a contact surface area against the planar axial extending wall of slot 62 shown in FIGS. 4A-4C. Slot 62 can have a contoured radially outer surface 100 to allow swash plate 18 to pivot about key 58 without interference. A gap between contoured radially outer surface 100 and key 58 can be maintained as the tilt angle of swash plate 18 is changed. Slot 62 is configured to provide positive engagement with key 58 at all tilt angles. As illustrated, the contact surface area can be smallest when swash plate 18 is positioned at the zero-degree tilt angle when there is no axial load placed on swash plate 18 by pistons 46. The contact surface area can increase as the inclination angle of swash plate 18 increases to transmit higher loads.

Figure 5:
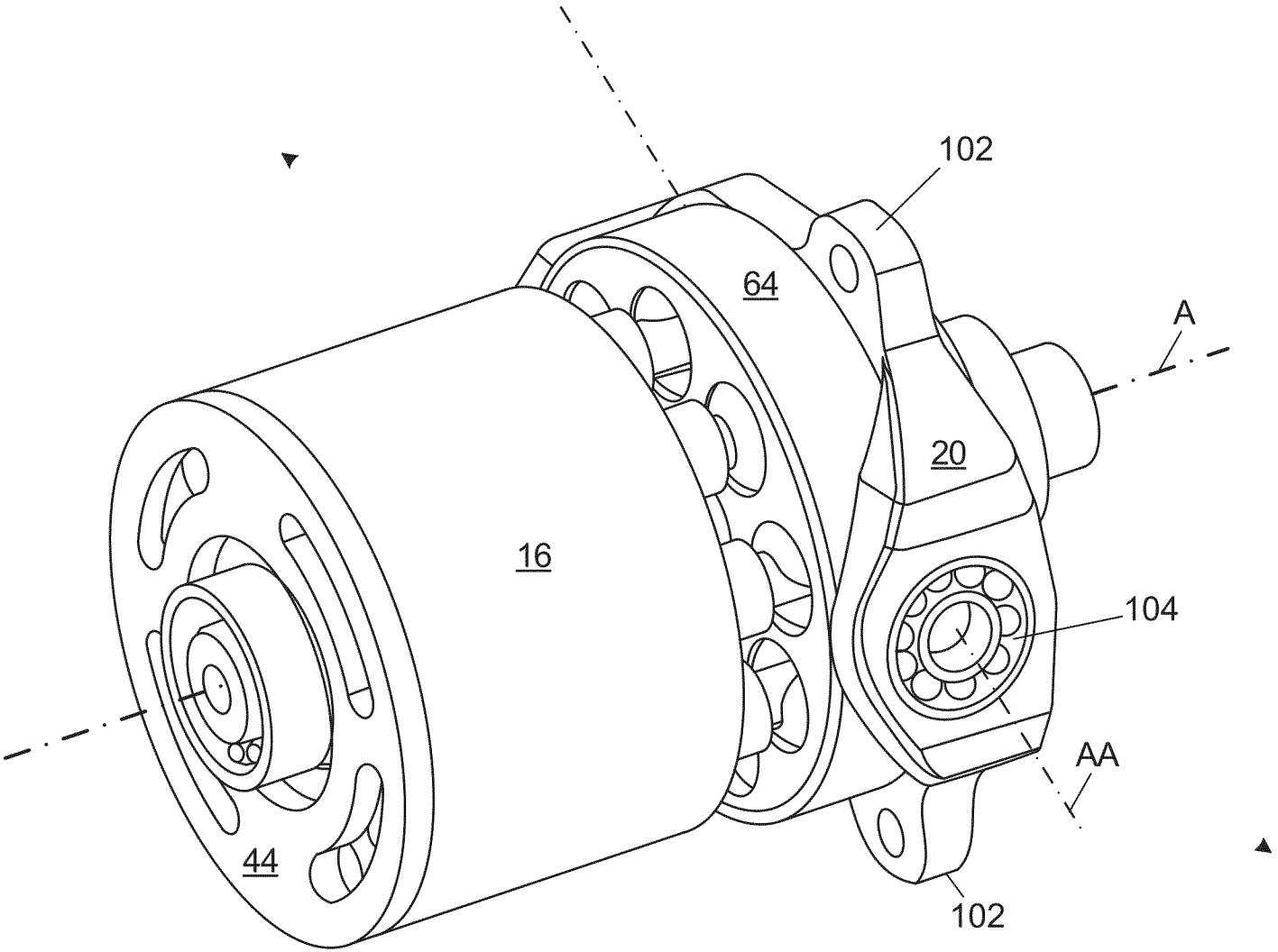
FIG. 5 is perspective view of a portion of the straight axis variable displacement piston pump of FIGS. 1A and 1B.

FIG. 5 is a perspective view of a portion of pump 10. FIG. 5 shows piston barrel 16, base plate 20, thrust plate 44, pistons 46, and retention cage 64. Base plate 20 can include actuation connections 102 and bearing 104 disposed on axis AA. Each of actuation connections 102 can be coupled to an actuation arm (not shown) configured to pivot base plate 20 about axis AA to change the angle of swash plate 18 (shown in FIGS. 1A and 1B). Axis AA is perpendicular to axis A (shown in FIGS. 1A and 1B). Base plate 20 can be supported by housing 12 (not shown) via bearing 104. Bearing 104 allows base plate 20 to pivot around axis AA to vary the angle of swash plate 18 connected thereto via bearing 78 (shown in FIGS. 1A and 1B).

The disclosed axial variable displacement piston pump having co-rotating swash plate and piston barrel provides increased robustness at higher fluid temperatures and pressures than prior art designs. The components disclosed herein can be utilized to reduce pump weight and cost.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

Discussion of Possible Embodiments

The following are non-exclusive descriptions of possible embodiments of the present invention.

The axial variable displacement piston pump of the preceding paragraph can optionally include, additionally and/or alternatively, any one or more of the following features, configurations, and/or additional components:

An embodiment of the preceding axial variable displacement piston pump can further include a base plate coupled to the swash plate by a first bearing, wherein the base plate is rotationally fixed relative to the swash plate.

In an embodiment of any of the preceding axial variable displacement piston pumps, the base plate can be mechanically coupled to an actuator, the actuator configured to vary a tilt angle of the base plate relative to the axis.

In an embodiment of any of the preceding axial variable displacement piston pumps, the swash plate can include a hub received on the drive shaft and a disc extending radially outward from the hub with the disc having a first side facing the piston barrel and an opposing second side facing the base plate. The hub can have a forward end extending axially outward from the first side of the disc, an aft end extending axially outward from the second side of the disc, and a radially inner surface facing the drive shaft. The radially inner surface at the aft end can be defined by an expanding diameter to an aftmost end of the hub.

In an embodiment of any of the preceding axial variable displacement piston pumps, the radially inner surface of the forward end of the hub can be defined by an expanding diameter to a forwardmost end of the hub.

An embodiment of any of the preceding axial variable displacement piston pumps can further include a socket disposed about the drive shaft between the piston cylinder and the swash plate. The socket can include a cradle configured to receive the forward end of the hub of the swash plate, wherein the forward end of the hub is slidingly engaged with the cradle.

In an embodiment of any of the preceding axial variable displacement piston pumps, the forward end of the swash plate can have a curved radially outer surface defined by a decreasing diameter from a location adjacent to the disc to a forwardmost end of the hub.

In an embodiment of any of the preceding axial variable displacement piston pumps, the cradle can have a contoured surface corresponding to the curved radially outer surface of the forward end of the swash plate.

An embodiment of any of the preceding axial variable displacement piston pumps can further include a key disposed between the drive shaft and the swash plate. The key can be received in a first slot in the drive shaft and a second slot in the swash plate. The second slot can open to the inner surface of the hub and the hub can be free to pivot about the key.

In an embodiment of any of the preceding axial variable displacement piston pumps, the second slot can axially overlap the disc.

In an embodiment of any of the preceding axial variable displacement piston pumps, minimum inner diameter of the hub is located in the region of the second slot.

The axial variable displacement piston pump of claim 11, wherein a maximum inner diameter of the hub can be located in the aft end of the hub.

In an embodiment of any of the preceding axial variable displacement piston pumps, the second slot can have a contoured radially outer surface.

The axial variable displacement piston pump of claim 9, wherein the second slot has a first axial length and the key has a second axial length less than the first axial length.

In an embodiment of any of the preceding axial variable displacement piston pumps, the drive shaft can include an annular land extending radially outward from the drive shaft, the annular land including the first slot.

In an embodiment of any of the preceding axial variable displacement piston pumps, the annular land can have a third axial length less than the first axial length.

In an embodiment of any of the preceding axial variable displacement piston pumps, the first bearing can be a tapered roller bearing.

An embodiment of any of the preceding axial variable displacement piston pumps can further include a second bearing disposed between the piston cylinder and the drive shaft, wherein the second bearing is a self-aligning ball bearing.

An embodiment of any of the preceding axial variable displacement piston pumps can further include a thrust plate disposed between the piston barrel and a housing, the piston barrel configured to rotate against the thrust plate.

An embodiment of any of the preceding axial variable displacement piston pumps can further include a retention cage connected to the swash plate between the piston barrel and the swash plate and a plurality of piston shoes disposed on the swash plate and coupled to the plurality of pistons.

The plurality of piston shoes and plurality of pistons coupled thereto can be retained against the swash plate by the retention cage.

The invention claimed is:

1. An axial variable displacement piston pump comprising:

a drive shaft disposed on an axis;

a piston barrel disposed about the drive shaft, the piston barrel comprising a plurality of pistons;

a swash plate disposed about the drive shaft; and a key disposed between the drive shaft and the swash plate and received in a slot of the swash plate, wherein the swash plate is free to pivot about the key and wherein the slot has a first axial length greater than a second axial length of the key;

wherein each of the piston barrel and the swash plate are rotationally coupled to the drive shaft such that the drive shaft is configured to simultaneously drive rotation of each of the piston barrel and the swash plate.

2. The axial variable displacement piston pump of claim 1 and further comprising a base plate coupled to the swash plate by a first bearing, wherein the base plate is rotationally fixed relative to the swash plate.

3. The axial variable displacement piston pump of claim 2, wherein the base plate is mechanically coupled to an actuator, the actuator configured to vary a tilt angle of the base plate relative to the axis.

4. The axial variable displacement piston pump of claim 3, wherein the swash plate comprises:

a hub received on the drive shaft; and a disc extending radially outward from the hub, the disc having a first side facing the piston barrel and an opposing second side facing the base plate;

wherein the hub has a forward end extending axially outward from the first side of the disc, an aft end extending axially outward from the second side of the disc, and a radially inner surface facing the drive shaft, wherein the radially inner surface at the aft end is defined by an expanding diameter to an aftmost end of the hub.

5. The axial variable displacement piston pump of claim 4, wherein the radially inner surface of the forward end of the hub is defined by an expanding diameter to a forwardmost end of the hub.

6. The axial variable displacement piston pump of claim 5, and further comprising a socket disposed about the drive shaft between the piston barrel and the swash plate, the socket comprising a cradle configured to receive the forward end of the hub of the swash plate, wherein the forward end of the hub is slidingly engaged with the cradle.

7. The axial variable displacement piston pump of claim 6, wherein the forward end of the hub has a curved radially outer surface defined by a decreasing diameter from a location adjacent to the disc to a forwardmost end of the hub.

8. The axial variable displacement piston pump of claim 7, wherein the cradle has a contoured surface corresponding to the curved radially outer surface of the forward end of the hub.

9. The axial variable displacement piston pump of claim 1, wherein the key is received in a slot in the drive shaft.

10. The axial variable displacement piston pump of claim 9, wherein the slot in the swash plate axially overlaps the disc.

11. The axial variable displacement piston pump of claim 9, wherein a minimum inner diameter of the hub is located in the region of the slot in the swash plate.

12. The axial variable displacement piston pump of claim 11, wherein a maximum inner diameter of the hub is located in the aft end of the hub.

13. The axial variable displacement piston pump of claim 9, wherein the slot in the swash plate has a contoured radially outer surface, the contoured radially outer surface defined by at least two concave regions.

14. The axial variable displacement piston pump of claim 11, wherein the drive shaft comprises an annular land extending radially outward from the drive shaft, the annular land comprising the slot in the drive shaft.

15. The axial variable displacement piston pump of claim 12, wherein the annular land has a third axial length less than the first axial length.

16. The axial variable displacement piston pump of claim 2, wherein the first bearing is a tapered roller bearing and further comprising a second bearing disposed between the piston barrel and the drive shaft, wherein the second bearing is a self-aligning ball bearing.

17. The axial variable displacement piston pump of claim 16 and further comprising a thrust plate disposed between the piston barrel and a housing, the piston barrel configured to rotate against the thrust plate.

18. The axial variable displacement piston pump of claim 2 and further comprising:

a retention cage connected to the swash plate between the piston barrel and the swash plate; and a plurality of piston shoes disposed on the swash plate and coupled to the plurality of pistons, wherein the plurality of piston shoes and plurality of pistons coupled thereto are retained against the swash plate by the retention cage.

19. An axial variable displacement piston pump comprising:

a drive shaft disposed on an axis;

a cradle extending radially outward from the drive shaft and having a concave surface;

a piston barrel disposed about the drive shaft, the piston barrel comprising a plurality of pistons; and a swash plate disposed about the drive shaft, the swash plate comprising a hub and a disk;

wherein each of the piston barrel and the swash plate are rotationally coupled to the drive shaft such that the drive shaft is configured to simultaneously drive rotation of each of the piston barrel and the swash plate; and wherein the cradle is configured to receive a forward end of the hub, the forward end of the hub slidingly engaged with the concave surface of the cradle.

20. The axial variable displacement piston pump of claim 19, wherein the forward end of the hub has a convex surface having a curvature complementary to a curvature of the concave surface of the cradle and wherein the cradle is defined at an end of a sleeve, the sleeve disposed about the drive shaft and rotationally coupled thereto.

* * * * *